US005133154A

United States Patent [19]

Kalleberg

[11] Patent Number: 5,133,154

[45] Date of Patent: Jul. 28, 1992

[54] APPARATUS AND FIXTURE FOR USE IN GRINDING THE NEEDLE TIP AND THE NEEDLE SEAT IN A FUEL VALVE

[76] Inventor: Jacob Kalleberg, Dalbolia 4, Posebyen, Kristiansand S, Norway, 4600

[21] Appl. No.: 469,493

[22] PCT Filed: Oct. 15, 1987

[86] PCT No.: PCT/NO87/00066

§ 371 Date: Apr. 12, 1990

§ 102(e) Date: Apr. 12, 1990

[87] PCT Pub. No.: WO89/03280

PCT Pub. Date: Apr. 20, 1989

[51] Int. Cl.[5] ..... B24B 15/04

[52] U.S. Cl. ..... 51/105 VG; 51/181 NT; 51/241 VS; 51/3

[58] Field of Search ..... 51/317, 181 NT, 241 VS, 51/3, 27, 216 R, 217 R, 227 R, 105 VG

[56] References Cited

U.S. PATENT DOCUMENTS

| | | | |
|---|---|---|---|
| 1,183,855 | 5/1916 | Clarkson | 51/241 VS |
| 1,993,844 | 3/1935 | Karnath | 51/241 VS |
| 3,021,651 | 2/1962 | Fuller et al. | 51/241 VS |
| 3,388,232 | 6/1968 | Dreisin | 51/27 X |
| 3,813,635 | 5/1965 | Spirounis | 51/241 VS |
| 4,687,142 | 8/1987 | Sasao et al. | 51/317 X |

FOREIGN PATENT DOCUMENTS

| | | |
|---|---|---|
| 456735 | 2/1928 | Fed. Rep. of Germany . |
| 123072 | 12/1971 | Norway . |
| 141503 | 3/1980 | Norway . |
| 1121440 | 7/1968 | United Kingdom . |

*Primary Examiner*—D. S. Meislin
*Attorney, Agent, or Firm*—Darby & Darby

[57] ABSTRACT

An apparatus for use in grinding the needle tip and seat in the needle housing of a fuel valve includes a grinding pin (1) and a holder (4) for the grinding pin. The holder (4) is shaped and dimensioned to be guidingly received within the needle bore (45) of the needle housing. The grinding pin (1) has a first conical end (2) adapted for the seat, and a second hollow conical end (3) adapted for the needle tip. Advantageously the grinding pin is a disposable grinding pin made of hardened steel. A fixture for fixing the needle housing (34) when using the apparatus is also described.

16 Claims, 2 Drawing Sheets

APPARATUS AND FIXTURE FOR USE IN GRINDING THE NEEDLE TIP AND THE NEEDLE SEAT IN A FUEL VALVE

The invention relates to an apparatus for use in grinding the needle tip and seat in the needle housing of a fuel valve. The invention also relates to a fixture for fixing the needle housing when using the new apparatus.

A needle housing in a fuel valve has a needle bore for receiving a needle. Uppermost or at the top the needle housing has a ground surface from which an inclined bore leads down to a ring-shaped space located at the inner end of the needle bore. At this location there is provided a seat intended for sealing against the needle tip. The sealing face of the needle tip against this seat should be on the largest diameter of the needle tip and be as narrow as possible in order to obtain a good atomization of the fuel which is supplied through the inclined bore as mentioned above. To obtain this desired narrow sealing face the needle tip and seat must be ground with an angular difference of 0.5°–1°. The invention has been developed in connection with the desire and need of being able to perform this grinding in a rational and automated way, and in this connection there is according to the invention provided an apparatus which is characterized in that it comprises a grinding pin and a holder for the grinding pin, the holder being shaped and dimensioned to be guidingly received in the needle bore of the needle housing and the grinding pin having a first conical end adapted for the seat and a second hollow conical end adapted for the needle tip.

Preferably the grinding pin is made for single use, for example from hardened steel.

For the purpose of grinding the needle, the holder is advantageously provided with a split ring placed in a circumferential groove, the ring having a diameter a little larger than the needle bore, with an axial stopper pin in the holder entering the opening of the split ring, the grinding pin and holder having cooperating elements for locking with a view towards relative rotation.

Because the split ring has a diameter a little larger than the needle bore, it will attain a slight tensioning against the wall of the needle bore when the holder is inserted into the needle bore. Before the holder is put into the needle bore, the grinding pin is placed in the holder whereby the mentioned cooperating elements are caused to interlock. The holder with the grinding pin is inserted into the needle bore until the conical end of the grinding pin, which protrudes from the holder, bears against the seat in the needle housing. The needle housing is fixed in a suitable way in a grinding machine, and the needle which is to be ground is inserted into the needle bore such that the needle tip enters the hollow conical end of the grinding pin. Then, when the needle is brought into rotation, the holder firstly will try to follow the rotational movement. The stopper pin mentioned, however, will bear against one of the ends at the opening of the split ring and thus act on the split ring to expand it, whereby the holder will be locked in the needle bore. This will also lock the grinding pin.

Advantageously the ends at the opening of the split ring can be tapered such that they converge in an outward radial direction, thus to form inclined flanks for cooperation with the stopper pin.

The mentioned cooperating elements may advantageously comprise a locking pin and a locking groove.

The locking groove may advantageously have the shape of a bayonet groove.

Fuel valves with a small difference between the diameter of the needle bore and the largest seat diameter will require an embodiment of the grinding pin as two separate parts to attain a step-down, such that there is attained room for the expansion ring and the stopper pin.

Advantageously there may in a circumferential groove in the holder be mounted an O-ring. This O-ring contributes to the beginning locking of the holder and furthermore also serves for sealing, a function whose purpose will be explained in further detail below in connection with the new fixture.

As mentioned the invention also relates to a fixture for fixing the needle housing when using the apparatus according to the invention, and such a fixture is according to the invention characterized by a bottom plate with a blind bore for receiving the nozzle part of the needle housing. An O-ring to be laid in therebetween, a bore for the supply of compressed air to the room within the blind bore under the nozzle part is provided. A crossbar which can be mounted to the bottom plate abutting the top of the needle housing is provided. A seal to be laid in therebetween sealing the fuel supply bore in the needle housing.

Such a fixture offers advantages. The needle housing is placed in the fixture, with the nozzle part placed in the blind bore. The O-ring will seal between the nozzle part and the blind bore. The needle housing is fixed by means of the crossbar while the mentioned seal, preferably a ring seal, is caused to seal against the fuel supply bore, that is, the opening of this bore at the top of the needle housing. Fixed in the fixture, the grinding is performed by coupling the fixture to a suitable grinding machine. When the grinding is finished, compressed air is supplied to the room in the blind bore under the nozzle part. The pressure propagates through the nozzle openings and will "shoot up" the grinding pin and the holder. This assembly, consisting of the grinding pin and the holder, can be caught above the top of the needle housing with the palm of the hand. The assembly will float on the stream of air and will be easy to catch. To obtain this blowing-out, the holder is provided with the O-ring mentioned before. Advantageously there may also be provided an O-ring between the grinding pin and the holder such that the pin is "floating" und thus self-centering.

When grinding the seat of the needle housing the grinding pin is exchanged into a suitable holder for this purpose. This holder is shaped for interlocking with the grinding pin, in the same way as the holder which is used for grinding the needle tip, but otherwise it is just shaped as a cylindrical body which can be guidingly received in the needle bore of the needle housing. The holder is provided with means, for example an end projection, for coupling to a grinding machine such that the whole assembly can be put into rotation for grinding the seat. Here the O-ring holds the grinding tip in place (a kind of locking).

The invention will be more closely described with reference to the drawings, wherein.

Figure 1:
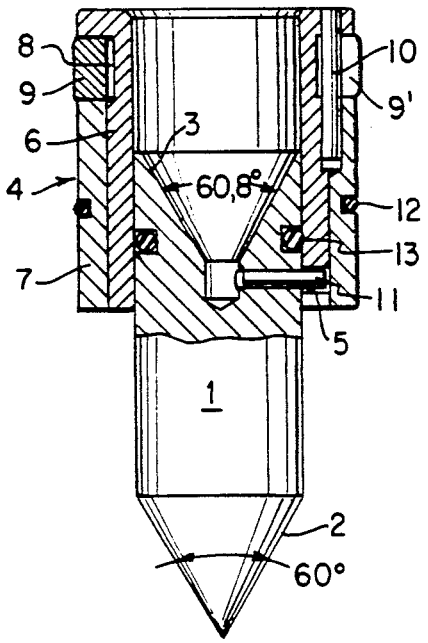
FIG. 1 shows an upright partial section of a typical grinding pin and holder for grinding the needle in a fuel valve.

In FIG. 1 there is shown a grinding pin 1 shaped with a first conical end 2 and a second hollow conical end 3. The first conical end is adapted for the seat of a fuel valve while the second hollow conical end 3 is adapted for the needle tip. Thus it is indicated in FIG. 1 that the first conical end should have an angle of 60° while the hollow conical end should have an angle of 60.8°.

The holder 4 is, in order to ease the shaping of a bayonet groove 5, embodied as an inner casing 6 and an outer, shorter casing 7 whereby there is formed a groove 8 uppermost in the holder, wherein there is placed an expansion ring or friction ring 9. The expansion ring is split, such, as is apparent both from FIG. 1 and 2, and the ends 9' at the opening of the expansion ring are tapered, with a radially outward convergence (see FIG. 2). In the holder there is mounted an axial stopper pin 10 which enters the opening of the split ring 9.

For interlocking the grinding pin 1 and the holder 4 there is in the grinding pin fitted a locking pin 11 which cooperates with the bayonet groove 5 in the inner casing 6.

On the holder there is an O-ring 12 mounted in a circumferential groove. Likewise there is an O-ring 13 mounted in a circumferential groove in the grinding pin 1.

Figure 3:
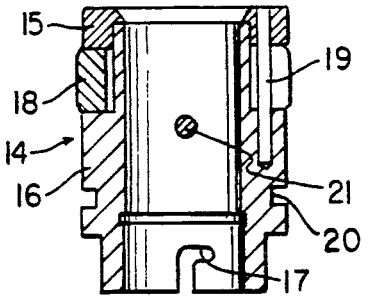
FIG. 3 shows a longitudinal section of a slightly different embodiment of a holder.
Figure 4:
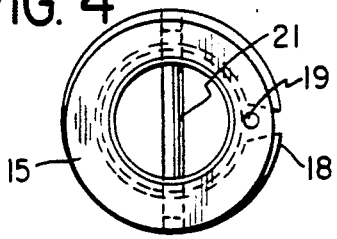
FIG. 4 shows a top view of the holder of FIG. 3

FIG. 3 and 4 show a modified embodiment of the holder. The holder shown in FIG. 3 and 4 is assembled from two components 15 and 16. The holder is provided with a bayonet groove 17 which corresponds to the bayonet groove 5 in the embodiment according to FIG. 1 and 2. Between the two components 15 and 16 there is room for a split ring 18 which corresponds to the split ring 9 of FIG. 1 and 2. Also in the present case there is an stopper pin 19 corresponding to the stopper pin 10 of FIG. 1 and 2. In the holder there is machined a groove 20 for an O-ring (not shown). A pin 21 extends transversely through the bore in the holder.

Figure 2:
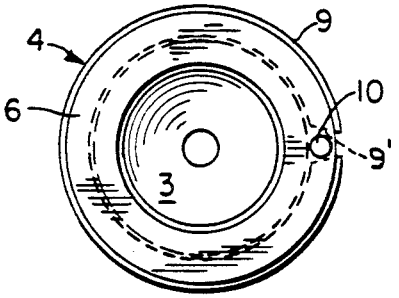
FIG. 2 shows a top view of the embodiment of FIG. 1.
Figure 6:
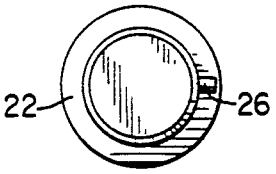
FIG. 6 shows a top view of FIG. 5.
Figure 7:
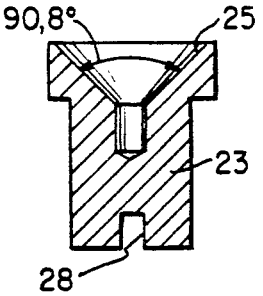
FIG. 7 shows a longitudinal section of the upper part of the two-part grinding pin.
Figure 5:
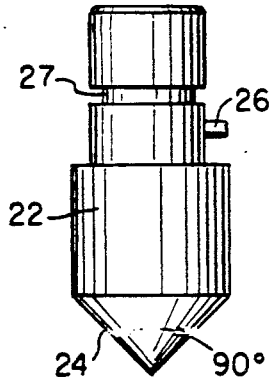
FIG. 5 shows the lower part of a two-part grinding pin.
Figure 8:
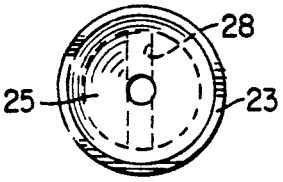
FIG. 8 shows a top view of FIG. 7.

In FIG. 5–8 there is shown a two-part grinding pin. The lower part 22 is shown in FIG. 5 and 6 while the upper part 23 is shown in FIG. 7 and 8. The lower part 22 has a conical end 24. The upper part 23 has a hollow conical end 25. The lower part of the grinding pin shown in FIG. 5 and 6 has a locking pin 26 intended for cooperation with the bayonet groove 17 in the holder of FIG. 3 and 4. Furthermore it has a circumferential groove 27 for an O-ring which is not shown. The upper part 23 of the grinding pin has at its other end a groove 28 intended for cooperation with the pin 21 in the holder of FIG. 3 and 4. During assembly the upper part 23 is inserted into the holder 14 from above while the lower part 22 of the grinding pin is inserted from below. Of course, the holder of FIG. 3 and 4 can also be used for a grinding pin as shown in FIG. 1 and 2. In this case one just removes the pin 21.

Figure 9:
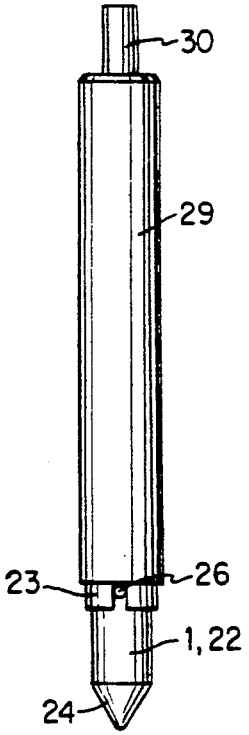
FIG. 9 shows a pin with a holder for grinding the seat.

In FIG. 9 a grinding pin, for example the grinding pin 1 as shown in FIG. 1 and 2, is shown mounted in a holder, ready for grinding the seat in the needle housing. The holder is in FIG. 9 shaped as a slim cylindrical body, shaped and dimensioned to be guidingly received in the needle bore in the needle housing. At its protruding end, when placed in the needle bore, the cylinder 29 has an extension 30 for coupling to a driving mechanism.

Figure 11:
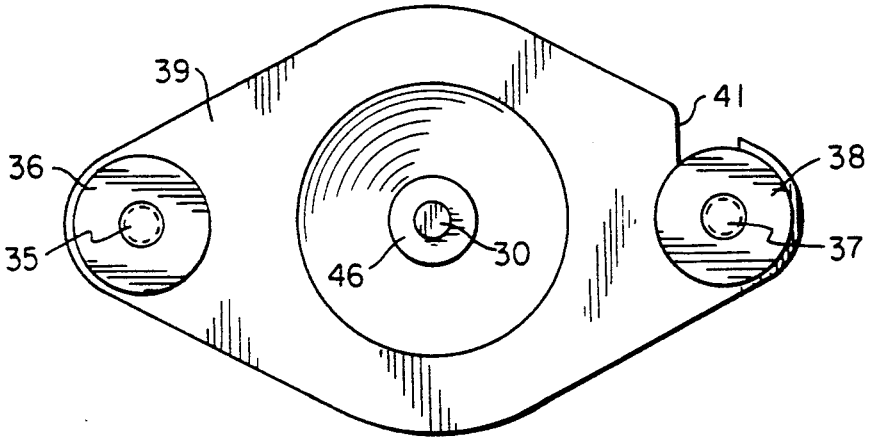
FIG. 11 shows a top view of the crossbar and slit.
Figure 10:
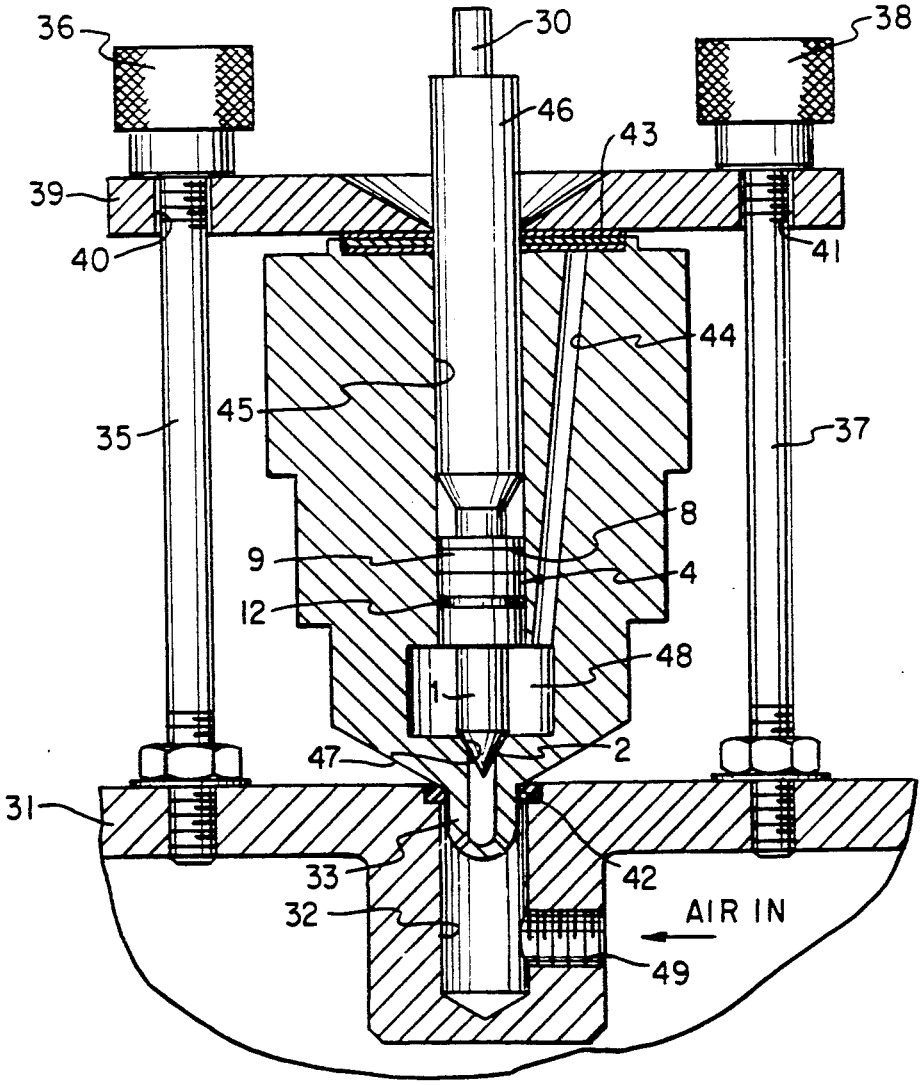
FIG. 10 shows section of a fixture according to the invention, with a holder and grinding pin for grinding the needle tip.

In FIG. 10 and 11 there is shown a fixture for fixing a needle housing when using an apparatus for example of the type shown in FIG. 1 and 2. The fixture includes a bottom plate 31, provided with a blind bore 32 for receiving the nozzle part 33 of a needle housing 34. Into the bottom plate 31 there is screwed a stand bolt 35 with a clamping nut 36 as well as a stand bolt 37 with a clamping nut 38. A crossbar 39 has a bore 40 such that the crossbar can be placed on the stand bolt 35. Furthermore the crossbar has an opening 41 directed sideways such that the crossbar can be swung into and out of engagement with the other stand bolt 37 such as it appears from FIG. 10 and 11.

The needle housing 34 is clamped against the bottom plate 31 with the nozzle part 33 of the needle housing, as mentioned already, positioned in the blind bore 32 with an O-ring 42 laid in therebetween. The crossbar 39 is swung into position with a ring seal 43 laid in between the top of the needle housing 34 and the crossbar, thus to seal off the tilted fuel supply bore 44 in the needle housing. The needle housing is clamped into position by means of the nuts 36, 38.

A holder 4 with corresponding grinding pin 1 is placed in the needle bore 45, see FIG. 10, and the needle 46 which is to be ground is then inserted into the needle bore, such that the needle tip, not shown, bears against the hollow conical bore 3 in the grinding pin 1 (see FIG. 1).

In a not specifically shown way the needle 46 is then brought into rotation, for example by introducing the fixture into a grinding machine. Acted on by the rotating needle the holder 4 will seek to rotate, but the stopper pin 10 (see FIG. 1 and 2) will then act on the split ring 9 such that the latter expands and bears against the wall of the needle bore 45. This will fix the holder in relation to the needle housing. It will also fix the grinding pin 1 in relation to the needle housing. The grinding pin 1 will be placed in the seat 47 in the ring-shaped room 48 of the needle housing in a centering way such that one attains a desired guidance.

When the grinding is finished, pressurized air is applied through the bore 49 which leads in to the blind bore 32. The pressurized air will enter through the nozzle holes in the nozzle part and will "shoot out" the holder 4 and corresponding grinding pin 1. One can easily catch these parts by hand and thus remove them. The crossbar 39 is loosened and swung away to the side, and then the needle housing 34 can be taken out.

The advantage which is realized according to the invention is in particular that the needle housing itself is exploited as a guide. The holder is locked against rotational movement as a stopper pin will act on the split ring or expansion ring. The assembly which consists of the grinding pin and the holder can easily be removed from the needle housing again after the grinding is finished, by means of pressurized air as described before. The needle housing will provide an ideal guidance because the needle and the needle housing are closely adapted to each other in diameters. Thus great precision is achieved. The flexible expansion ring or friction ring will be able to tolerate a certain variation in diameters. Advantageously disposable grinding pins of hardened steel are used.

I claim:

1. An apparatus for use in grinding a needle tip and seat in a needle bore of a needle housing of a fuel valve, comprising:

a grinding pin having a first conical end adapted for being received in the seat and a second hollow conical end adapted for receiving the needle tip;

a holder for holding means for the grinding pin in a self-centering and self-locking manner, the holder means having means for inserting and locking said holder means dimensioned to be guidingly inserted into and locked within the needle bore, the grinding pin and holder having cooperating elements which engage each other for locking the pin and holder together against relative rotation, the holder being a casing that has a circumferential groove which carries a split ring having a diameter larger than the needle bore and being split to define an opening; and an axial stopper pin in the holder entering the opening of the split ring.

2. Apparatus according to claim 1, wherein the ends of the split ring at the opening of the split ring are tapered such that they converge in outward radial directions.

3. Apparatus according to claim 1, wherein the cooperating elements comprise a locking pin and a locking groove which lock together for locking the pin and the holder means together.

4. Apparatus according to claim 3, wherein the grinding pin is separated into an upper and a lower part.

5. Apparatus according to claim 4, further comprising an O-ring mounted in a circumferential groove in the holder means.

6. Apparatus according to claim 5, further comprising an O-ring mounted in a circumferential groove in the grinding pin.

7. Fixture for fixing the needle housing in combination with the apparatus according to claim 1, further comprising a bottom plate with a blind bore;

an O-ring in the blind bore, the blind bore receiving via insertion through the O-ring of a valve part of the needle housing; the bottom plate having a bore through which may be supplied compressed air from outside the bottom plate and into a space within the blind bore located under the valve part;

a crossbar mounted to the bottom plate and abutting the top of the needle housing; and a seal which seals a fuel supply bore in the needle housing.

8. Apparatus according to claim 7, wherein the ends of the split ring at the opening of the split ring are tapered such that they converge in outward radial directions.

9. Apparatus according to claim 7, characterized in that the grinding pin is separated into an upper and a lower part.

10. Apparatus according to claim 7, wherein the cooperating elements comprise a locking pi and a locking groove which lock together for locking the pin and the holder means together.

11. Apparatus according to claim 10, wherein the grinding pin is separated into an upper part and a lower part.

12. An apparatus for use in grinding a needle tip and seat in a bore of a housing of a fuel valve, comprising:

a grinding pin having a first conical end adapted for being received in the seat of the housing and a second hollow conical end adapted for receiving the needle tip;

a holder for holding the grinding pin;

first means for locking said holder within the bore of the housing in response to rotation of the holder relative to the housing; and second means for locking said pin and holder together against relive rotation.

13. Apparatus according to claim 12, wherein said first means include engaging elements which engage each other in response to said rotation to cause one of the engaging elements to expand and bear against the housing so as to lock said holder and the housing together against relative rotation therebetween.

14. Apparatus according to claim 13, wherein said one engaging element is a split ring which is split at an opening so as to space two ends of a said split ring from each other, the other of the engaging element being arranged in said opening so as to engage one of said ends in response to said rotation.

15. Apparatus according to claim 14, wherein said ends taper so as to converge outwardly.

16. Apparatus according to claim 12, wherein said grinding pin has an upper part and a lower part secured to each other and separable from each other.

* * * * *